US010676313B2

(12) United States Patent
Kavanaugh et al.

(10) Patent No.: US 10,676,313 B2
(45) Date of Patent: Jun. 9, 2020

(54) MULTI-STEP LOKREEL AND CLIP SYSTEM

(71) Applicant: Advantek, Inc., St. Louis, MO (US)

(72) Inventors: Patrick Kavanaugh, Eau Claire, WI (US); Raymond J. Bloom, Eagan, MN (US); Todd Oliverius, Richfield, MN (US)

(73) Assignee: Advantek, Inc., St. Louis, MO (US)

( * ) Notice: Subject to any disclaimer, the term of this patent is extended or adjusted under 35 U.S.C. 154(b) by 6 days.

(21) Appl. No.: 16/217,786

(22) Filed: Dec. 12, 2018

(65) Prior Publication Data

US 2019/0337753 A1 Nov. 7, 2019

Related U.S. Application Data

(60) Provisional application No. 62/665,647, filed on May 2, 2018.

(51) Int. Cl.
*B65H 75/22* (2006.01)

(52) U.S. Cl.
CPC ..... *B65H 75/22* (2013.01); *B65H 2701/1942* (2013.01)

(58) Field of Classification Search
CPC .... B65H 75/14; B65H 75/22; B65H 2701/37; B65H 2701/1942
See application file for complete search history.

(56) References Cited

U.S. PATENT DOCUMENTS

| | | | | |
|---|---|---|---|---|
| 4,726,534 | A | 2/1988 | Chenoweth | |
| D363,659 | S | 10/1995 | Chenoweth | |
| 5,460,268 | A | 10/1995 | Chenoweth | |
| 5,524,850 | A * | 6/1996 | Liao | B65H 75/22 242/608.5 |
| 5,584,102 | A | 12/1996 | Chenoweth | |

* cited by examiner

*Primary Examiner* — Sang K Kim
(74) *Attorney, Agent, or Firm* — Vidas, Arrett & Steinkraus, P.A.

(57) ABSTRACT

A multi-step reel includes a first hub flange having a first arbor hole and a first platform area located outwardly from the first arbor hole. The first platform area has at least a first and second hub platform, each having a first and second depth dimension, respectively. A first outer flange area extends outwardly from the first platform area. A second hub flange has the identical elements as the first hub flange. One of the first and a second hub platforms of the first hub flange may be positioned adjacent to one of the first and second hub platforms of the second hub flange, defining a width dimension. A locking mechanism may be used to secure the first and second hub flanges together. One or more clips may be used to maintain the desired width dimension between the first and second outer flanges areas.

25 Claims, 8 Drawing Sheets

MULTI-STEP LOKREEL AND CLIP SYSTEM

CROSS-REFERENCE TO RELATED APPLICATIONS

This application claims the benefit of U.S. Provisional Patent Application Ser. No. 62/665,647 filed May 2, 2018 which is incorporated by reference herein in its entirety.

FIELD OF THE INVENTION

The present invention in general relates to a multi-step reel used for transportation of carrier tape or other flexible ribbon material. The multi-step reel is formed from a single mold which individually forms the two halves of the assembled multi-step reel. Each of the individual halves is identified as a hub flange. Each of the hub flanges includes three distinct hub platforms where each of the hub platforms has a different depth/height dimension. The two hub flange halves may be combined into three alternative separation widths by aligning different combinations of depth/height dimensions of the hub platforms, to provide a multi-step reel which has been configured to transport a desired width of carrier tape. The necessity for the use of one or two individual molds for the manufacture of reels to transport each desired width of carrier tape is thereby eliminated and replaced with a generic multi-purpose hub flange, which may be assembled into a number of different separation widths, significantly saving manufacturing expense.

The multi-step reel includes a first hub flange having a first arbor hole, and a first platform area. The first platform area is located outwardly from the first arbor hole. The first platform area has at least a first and second hub platform, where each of the first and second hub platforms have a different first and second depth dimension. A first outer flange area extends outwardly from the first platform area.

A second hub flange has the identical elements as the first hub flange. One of the first and second hub platforms of the first hub flange may be positioned adjacent to one of the first and second hub platforms of the second hub flange defining a desired separation width dimension between the respective first outer flange area and second outer flange area. A locking mechanism may be used to secure the first and second hub flanges together. Winding of carrier tape or another flexible ribbon material on the multi-step reel may then proceed for transportation of the material. One or more clips may be used to maintain a desired separation width distance between the first and second outer flange areas.

BACKGROUND OF THE INVENTION

Current reels for winding and protecting carrier tape are pre-assembled, bonded, 1-piece reels. Alternatively reels may be assembled from two or three components. Assembly of the components may consist of joining two hub/flange components together. Three-piece reels may also be used. The three-piece reels consist of two flanges and a central hub, which when joined create a single width of reel. Assemblies for more than a single width reel require multiple different SKU's to form the component parts for a desired size and width dimension for a reel used for transportation of carrier tape.

Reel flange components may include an external support. The external support for the reel flanges may be formed from continuous bands which are joined together at their ends, forming a protective band. The protective band provides support to the outside edges of the flanges, preventing compression of the outside edges of the flanges together when the reels are vacuum sealed in a protective bag. Each different reel width requires a matching band width, for the provision of the desired support for the exterior edges of the reel flanges.

The art referred to and/or described above is not intended to constitute an admission that any patent, publication or other information referred to herein is "prior art" with respect to this invention. In addition, this section should not be construed to mean that a search has been made or that no other pertinent information as defined in 37 C.F.R. § 1.56(a) exists.

All U.S. patents and applications and all other published documents mentioned anywhere in this application are incorporated herein by reference in their entirety.

Without limiting the scope of the invention, a brief description of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided for the purposes of complying with 37 C.F.R. § 1.72.

GENERAL DESCRIPTION OF THE INVENTION

In some embodiments, the hub/flange of the invention is formed of a generic all-inclusive design, which may be conveniently assembled into alternative configurations, forming a reel having two or more, and preferably three or more different reel widths. The multi-step reel accommodates up to three or more different widths of carrier tape, or other flexible ribbons of material, using two identical hub/flange components as formed from a single SKU. Two identical hub/flange components may be orientated relative to each other in a variety of combinations during assembly through the use of a hub having two or more, and preferably three or more, hub platforms of various desired heights. The height of the hub platforms are selected to conform to a desired width of carrier tape or flexible ribbon material.

In some embodiments the hub/flange components each include a number of windows corresponding to desired width of carrier tape or flexible ribbon material in order to permit users to visualize marking indicia identifying the width of carrier tape or flexible ribbon material to be transported on an assembled multi-step reel. Locking features are provided on the hub platforms. The locking features prevent the hub/flange components from inadvertently separating from each other following assembly. Assembly is accomplished by engaging the locking tabs of two hub flanges together and rotating the flanges in opposite directions from each other, in a clockwise direction, as viewed from the outside of the assembled reel.

Prior to assembly, the flange/hub component halves nest within each other for space savings during shipping and storage.

In at least one embodiment the platform areas have an arbor hole having up to or exceeding nine spline slots in order to facilitate engagement with a spindle which is used to turn the reel during the loading or unloading of carrier tape onto or from the reel.

Following the winding of carrier tape onto the reel, individual clips may be disposed around the perimeter of the reel to support the outer flange edges of the reel and to prevent the outer flange edges from compressing together when the hub/flanges are vacuum sealed in a protective bag.

In some embodiments the clips may be formed of a single piece of material and designed for a specific reel width. Alternatively the clips may be formed of a two-piece assembly allowing the clips to be adjustably connected together for use with a desired reel width.

In at least one embodiment, a multi-step reel includes a first hub flange which may be disc shaped having a first arbor hole, a first platform area, a first interior side, a first exterior side and a first outer flange area defining a plane. The first platform area is adjacent to and located outwardly from the first arbor hole. The first platform area has at a minimum a first hub platform and a second hub platform. The first hub platform has a first depth dimension relative to the plane and the second hub platform has a second depth dimension relative to the plane. The first outer flange area is adjacent to and extends outwardly from the first platform area. The first hub flange is connected to a second hub flange having a second arbor hole, a second hub area, a second interior side, a second exterior side, and a second outer flange area having a second plane. The second platform area is adjacent to and extends outwardly from the second arbor hole. The second platform area has at a minimum a third hub platform and a fourth hub platform, the third hub platform having a third depth dimension relative to the second plane and the fourth hub platform having a fourth depth dimension relative to the second plane. The second outer flange area is adjacent to and extends outwardly from the second platform area.

The first interior side of the first hub platform is disposed adjacent to the second interior side of one of the third hub platform and the fourth hub platform defining a tape width dimension. The first hub flange and the second hub flange are then engaged to each other through the use of a locking mechanism forming a multi-step reel having a desired interior width dimension for receipt of a desired width of carrier tape or other flexible ribbon material.

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

DETAILED DESCRIPTION OF THE PREFERRED EMBODIMENTS

Figure 1:
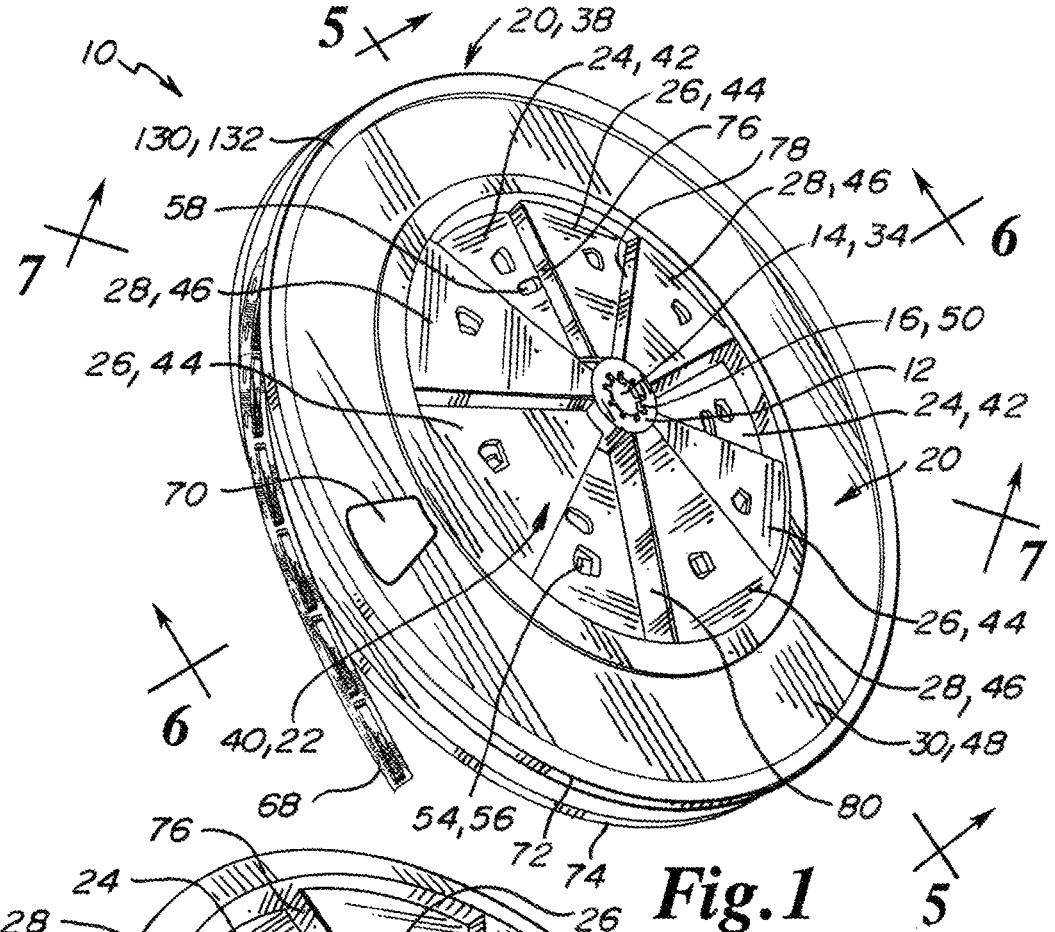
FIG. 1 is an isometric environmental view of one alternative embodiment of the assembled multi-step reel.

The multi-step reel is in general referred to by the numeral 10. As may be seen in FIGS. 1 and 2, the exterior of multi-step reel 10 includes a disc-shaped first hub flange shown in general by reference numeral 12, a first arbor hole 14 having spline slots 16, a first platform area 22, a first exterior side shown generally by reference numeral 20, a first hub platform 24, a second hub platform 26 and a third hub platform 28, and a first outer flange area 30.

In some embodiments, the first platform area 22 is integral with the first arbor hole 14 and spindle slots 16. In addition, the first outer flange area 30 is integral with and is disposed exterior to the first platform area 22. In at least one alternative embodiment the first outer flange area 30 is connected to, or is integral with, the first platform area 22.

In at least one alternative embodiment, each of the first hub platform 24, second hub platform 26 and third hub platform 28 include a descending and substantially horizontal first locking tab 54 which has been inwardly formed from the material of the first platform area 22, creating a first locking tab opening 66. The first platform area 22 may also include one or more reel width windows 58 which permit viewing of the interior of a second hub flange indicated generally by reference numeral 32.

In some embodiments as shown in FIG. 1, the first platform area 22 has three hub platforms. In alternative embodiments, the first platform area 22 may have two hub platforms, four hub platforms, five hub platforms or six or more hub platforms at the preference of an individual.

In at least one embodiment as shown in FIG. 1, a carrier tape or other flexible ribbon material 68 may be wound around the multi-step reel 10.

In some alternative embodiments, the first outer flange area 30 may include one or more flange windows 70 which permit observation of the amount of carrier tape 68 which has been wound or unwound onto or from the multi-step reel 10.

As seen in FIG. 1, the first outer flange area 30 includes a first outer flange edge 72 and the second outer flange area 48 includes a second outer flange edge 74.

In a preferred embodiment, as viewed from the interior, the first hub platform 24 has a first depth dimension, which is small or shallow relative to a plane as established by the first outer flange area 30 and the first exterior side 20 of the first hub flange 12.

In a preferred embodiment, as viewed from the interior, the second hub platform 26 has a second depth dimension, which is larger than the first depth dimension. The second depth dimension has an intermediate depth relative to the first depth dimension and the third depth dimension.

In a preferred embodiment, as viewed from the interior, the third hub platform 28 has a third and greater depth dimension than the second depth dimension, and is relatively deep as compared to the plane established by the first outer flange area 30, first exterior side 20, and the first hub flange 12.

Figure 5:
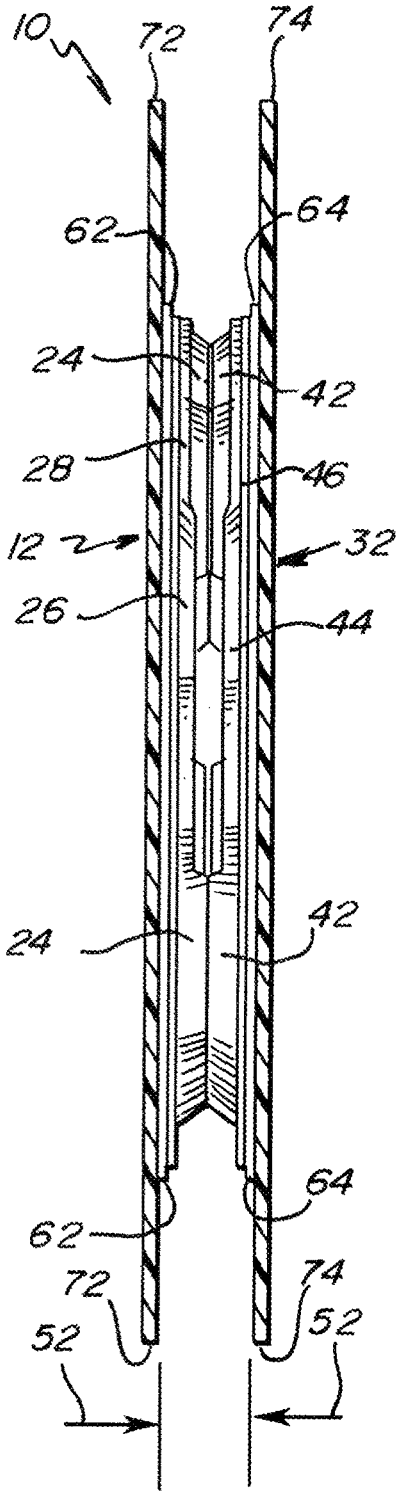
FIG. 5 is an alternative partial cross-sectional side view taken along the line 5-5 of FIG. 1, of one embodiment of the multi-step reel.
Figure 6:
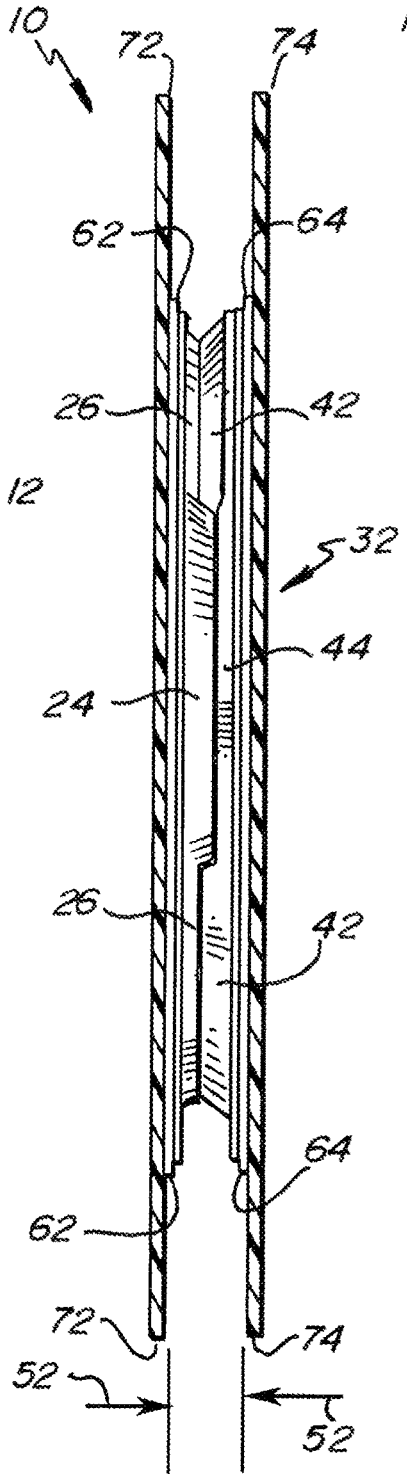
FIG. 6 is an alternative partial cross-sectional side view taken along the line 6-6 of FIG. 1, of one embodiment of the multi-step reel.
Figure 7:
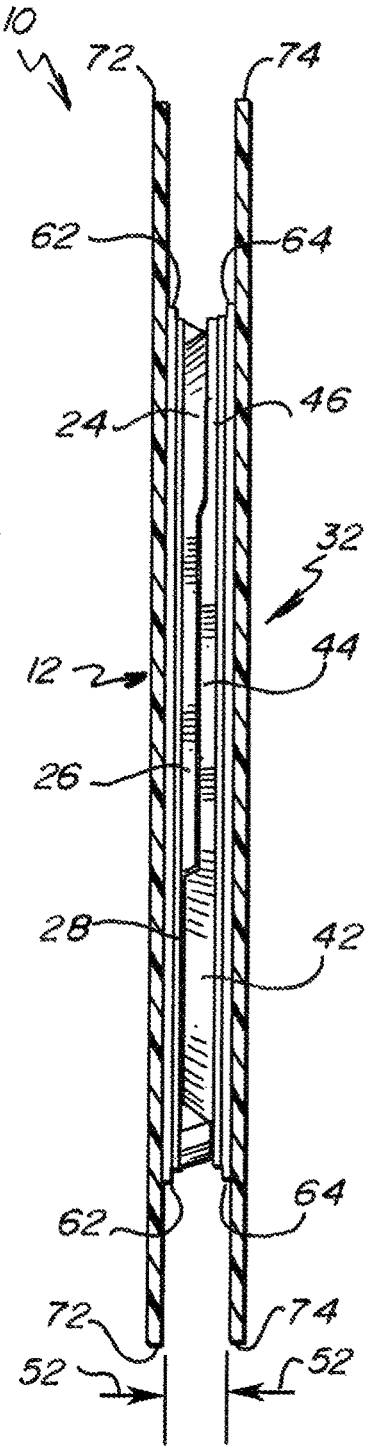
FIG. 7 is an alternative partial cross-sectional side view taken along the line 7-7 of FIG. 1, of one embodiment of the multi-step reel.

In a preferred embodiment, the different depth dimensions for the first hub platform 24, second hub platform 26 and third hub platform 28 are used to define a separation distance indicated by arrows 52 between the first outer flange area 30 and the second outer flange area 48 for receipt of a defined width of carrier tape or other flexible ribbon material 68. (FIGS. 5-7)

In some embodiments, the first arbor hole 14 and the second arbor hole 34 are of equal size having a dimension of approximately ½ inch in diameter.

In other embodiments, the size dimension for the first and second arbor holes 14, 34 may be larger or smaller than ½ inch in dimension dependent on the requirements of a specific application and material used for the hub flanges.

In at least one embodiment, the spline slots 16 are constructed and arranged for receipt of splines (not shown) of a driveshaft (not shown) which is used to rotate the multi-step reel 10 during winding and un-winding of carrier tape or other flexible ribbon material 68.

In at least one embodiment, the first, second, third, fourth, fifth and sixth hub platforms 24, 26, 28, 42, 44, 46 are substantially triangular or pie shaped. In alternative embodiments, the hub platforms may be round, oval, rectangular, square, or any other shape as desired provided that the remaining functions and attributes as described herein for the multi-step reel 10 are provided.

In some embodiments, the height differential between one hub platform of the first hub flange 12 and one of the hub platform of the second hub flange 32 will be equal to a differential input carrier tape width.

For example, if a 8 mm carrier tape 68 is to be transported, then as viewed from the interior, the depth dimension of the first and fourth hub platforms 24, 42 will be 8 mm less (higher elevation) than the depth dimension for the third and sixth hub platforms 28, 46 (lower elevation). The height of the first hub platform 24 may be of any dimension so long as the third and sixth hub platforms 28, 46, in this example, are 8 mm lower than level of the first and fourth hub platforms 24, 42.

In one embodiment, during use the top surface of the first hub platform 24 is aligned and in contact with the top surface of the sixth hub platform 46, providing a combined separation distance 52, between the first outer flange area 30 and the second outer flange area 48 of 8 mm.

In a second example, if a 12 mm carrier tape 68 is to be transported, then the relative depth dimension between the first and fifth hub platforms 24, 44 will be equal to 12 mm. In this example, the first hub platform 24 has a depth dimension which is 8 mm less (higher elevation) than the depth dimension for the sixth hub platform 46 (lower elevation). Also in this example, the fifth hub platform 44 has a depth dimension which is 4 mm less (higher elevation) than the depth dimension for the sixth hub platform 46 (lower elevation). During use, the top surface of the first hub platform 24 is aligned and in contact with the top surface of the fifth hub platform 44, providing a combined separation distance 52, between the first outer flange area 30 and the second outer flange area 48 of 8 mm plus 4 mm or equal to 12 mm.

In a third example, if a 16 mm carrier tape 68 is to be transported, then the relative depth dimension between the first and fourth hub platforms 24, 42 will be equal to 16 mm. In this example, the first hub platform 24 has a depth dimension which is 8 mm less (higher elevation) than the depth dimension for the sixth hub platform 46 (lower elevation). Also in this example, the fifth hub platform 44 has a depth dimension which is 4 mm less (higher elevation) than the depth dimension for the sixth hub platform 46 (lower elevation). Further in this example, the fourth hub platform 42 has a depth dimension which is 8 mm less (higher elevation) than the depth dimension for the sixth hub platform 46 (lower elevation). During use, the top surface of the first hub platform 24 is aligned and in contact with the top surface of the fourth hub platform 42, providing a combined separation distance 52, between the first outer flange area 30 and the second outer flange area 48 of 8 mm plus 8 mm equal to 16 mm.

In the above examples, the dimensions used for the first hub flange 12 and the second hub flange 32 are identical enabling the first hub flange 12 and the second hub flange 32 to be formed from a single SKU. Therefore, the relative depth dimension for the first hub platform 24 and fourth hub platform 42 are equal, the relative depth dimension for the second hub platform 26 and fifth hub platform 44 are equal, and the relative depth dimension for the third hub platform 28 and sixth hub platform 46 are equal. As identified from the above examples, a single configuration of a first hub flange 12 is identical to the configuration of a second hub flange 32, which during use will accommodate three different sizes of carrier tape or flexible ribbon material 68, namely 8 mm, 12 mm, or 16 mm in width.

In the above examples a combined separation distance 52 for combination of the first hub platform 24 and the fourth hub platform 46 will be 16 mm. A combined separation distance 52 for combination of either of the first hub platform 24 and the fifth hub platform 44, or alternatively the fourth hub platform 42 and the second hub platform 26, will be 12 mm. A combined separation distance 52 for combination of either of the first hub platform 24 and the sixth hub platform 46, or alternatively the fourth hub platform 42 and the third hub platform 28, will be 8 mm.

In the first example as provided above, the first hub platform 24 is positioned proximate to and is in contact with the sixth hub platform 46. In this configuration the second hub platform 26 is aligned and nested with the fourth hub platform 42. Likewise, the third hub platform 28 is aligned and nested with fifth hub platform 44.

In the second example identified above, the second hub platform 26 is aligned, positioned proximate to, and is in contact with, the fourth hub platform 42. In this configuration, the upper surface of the first hub platform 24 is aligned and nested relative to the upper surface of the sixth hub platform 46. In addition, in this configuration, the upper surface of the third hub platform 28 is aligned and nested relative to the fifth hub platform 44.

In the third example identified above, the first hub platform 24 is aligned and is in contact with the top surface of the fourth hub platform 42. In this configuration, the upper surface of the second hub platform 26 is aligned and is relatively proximate to the upper surface of the fifth hub platform 44. Further, in this configuration, the upper surface of the third hub platform 28 is aligned and is relatively proximate to the top surface of the sixth hub platform 46.

In alternative embodiments, the first, second, third, fourth, fifth and sixth hub platforms 24, 26, 28, 42, 44, 46 may have different paired depth dimensions to accommodate different sizes of carrier tape or flexible ribbon material 68, which may have a width dimension equal to, greater, or smaller than 24 mm, 32 mm, 44 mm, 56 mm, 72 mm and 88 mm to name a few.

In at least one embodiment, a first hub flange 12 and a second hub flange 32 may be engaged to each other to transport only two different width sizes of carrier tape of flexible ribbon material 68. For example, the depth dimension for the first and third hub platforms may accommodate a carrier tape having a width dimension of 12 mm and the pair of first and fourth hub platforms may accommodate a carrier tape having a width dimension of 56 mm. The first hub flange 12 and the second hub flange 32 may include any desired depth dimension for the first and third hub platforms and the first and fourth hub platforms as identified herein. It should be noted that the width dimensions identified herein for the carrier tape or flexible ribbon material 68 have been provided for illustrative purposes only, and the width dimensions of the carrier tape or flexible ribbon material 68 to be transported by the multi-step reel 10 are not restricted to the carrier tape or flexible ribbon material width dimensions as identified herein.

In other embodiments, the first hub flange 12 and the second hub flange 32 may be engaged to each other to transport different width sizes of carrier tape or flexible ribbon material 68. In this embodiment, each of the first hub flange 12 and the second hub flange 32 have three pairs of hub platforms. In other embodiments, the first hub flange 12 and the second hub flange 32 may have four, five, six or more pairs of hub platforms to accommodate the transportation of four, five, six or more different width dimensions of carrier tape or flexible ribbon material 68.

Figure 2:
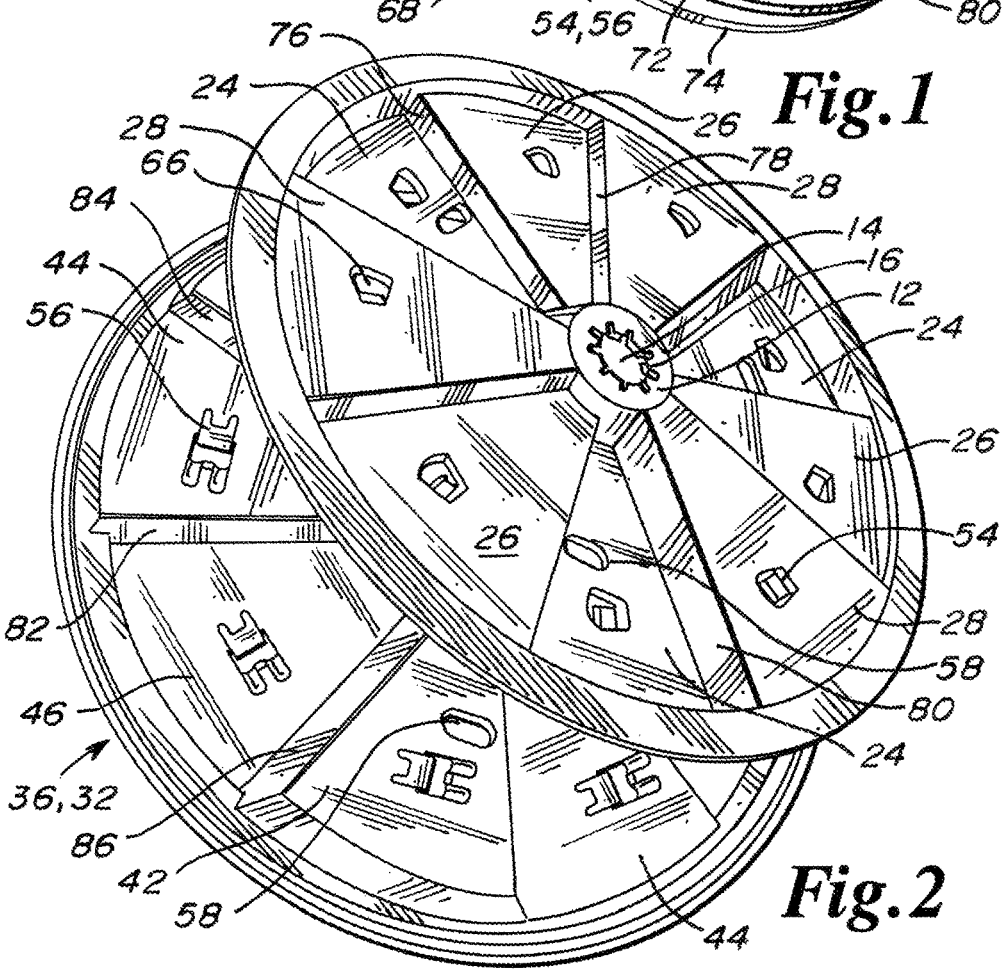
FIG. 2 is a detail isometric exploded view of one alternative embodiment of the first hub flange and the second hub flange prior to the engagement of the first hub flange to the second hub flange.

Continuing to refer to FIGS. 1 and 2, the first and second hub flanges 12, 32 include a substantially horizontal triangular or pie-shaped surface for the first, second, third, fourth, fifth and sixth hub platforms 24, 26, 28, 42, 44 and 46.

Figure 3:
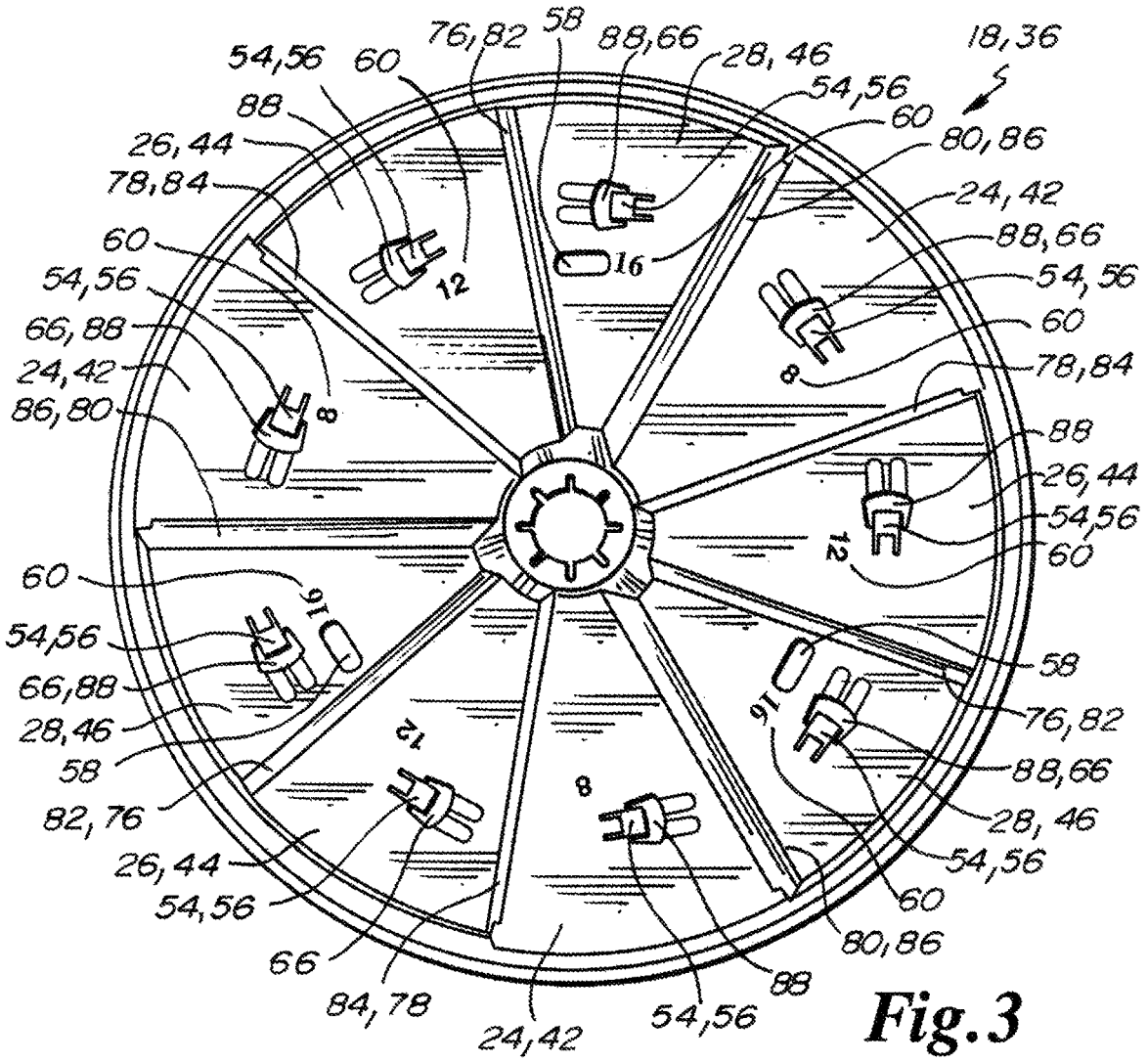
FIG. 3 is a rear detail perspective view of one alternative embodiment of the interior of a hub flange.

Referring to FIG. 3, a first interior side 18 of a first or second hub flange 12, 32 is shown. The first interior side 18 in addition to the elements as previously identified include a plurality of width markings 60. In at least one embodiment, each of the first, second, third, fourth, fifth and sixth hub platforms 24, 26, 28, 42, 44, 46 include an individual width marking 60.

In at least one embodiment, a substantially vertical first step wall 76 extends upwardly from the horizontal surface of the third hub platform 28 to the horizontal surface of the second hub platform 26. In addition, a second step wall 78 extends substantially vertically from the horizontal surface of the second hub platform 26 upwardly to the horizontal surface of the first hub platform 24.

Further, a third step wall 80 descends substantially vertically from the opposite side of the horizontal surface of the first hub platform 24 to the horizontal surface of the third hub platform 28. It should be noted that the combined height of the first step wall 76 and second step wall 78 is equal to the height dimension for the third step wall 80.

The fourth step wall 82, fifth step wall 84 and sixth step wall 86 are identical in dimension, construction and function as compared to the first step wall 76, second step wall 78 and third step wall 80.

Figure 4:
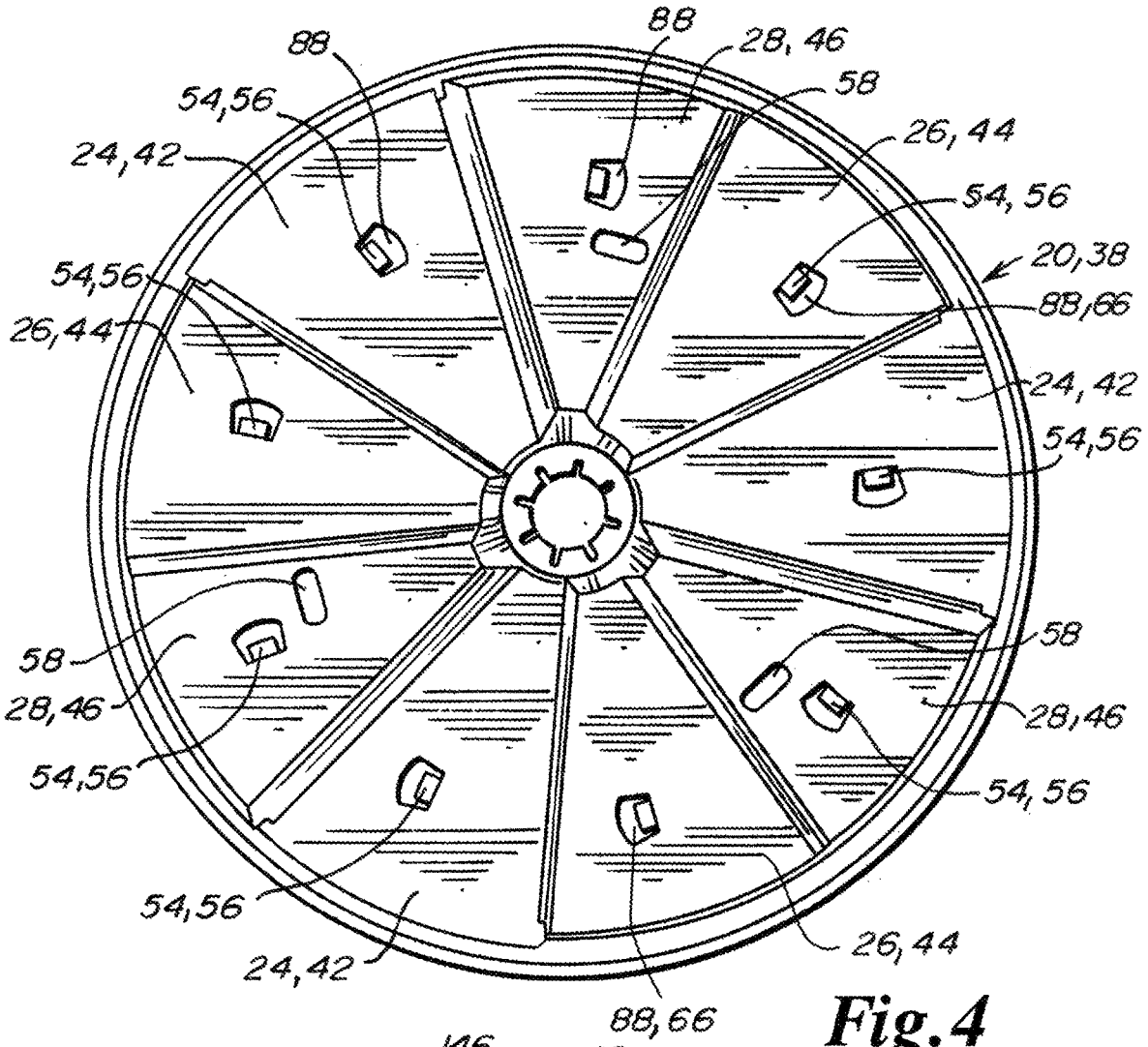
FIG. 4 is a front detail perspective view of one embodiment of the exterior of a hub flange.

As may be seen in FIGS. 3 and 4, the first and second locking tabs 54, 56 are integral to each of the first platform area 22 and second platform area 40, respectively. The first and second locking tabs 54, 56 may be formed simultaneously with the formation of the first hub flange 12 and the second hub flange 32. Alternatively, the first and second locking tabs 54, 56 may be formed by punching, cutting and/or bending of portions of the first hub flange 12 and/or the second hub flange 32.

Referring to FIG. 5, in at least one embodiment, the first hub platform 24 is aligned with the fourth hub platform 42, creating the largest separation distance between the first outer flange area 30 and the second outer flange area 48. In this embodiment, the tape width dimension 52 is 16 mm.

In addition, the first tape support ledge 62 and the second tape support ledge 64 are shown. In some embodiments, the first and second tape support ledges 62, 64 when the first hub phalange 12 is engaged to the second hub phalange 32, releasably engage the innermost portion of the carrier tape or flexible ribbon material 68 during winding or unwinding of the material onto or from the multi-step reel 10. The first tape support ledge 62 and the second tape support ledge 64 function in an identical manner for the tape width dimensions as identified with reference to FIG. 6 and FIG. 7.

Referring to FIG. 6, in at least one embodiment, the second hub platform 26 is aligned with the fourth hub platform 42 creating an intermediate separation distance 52 between the first outer flange area 30 and the second outer flange area 48. In this embodiment, the tape width dimension 52 is for example 12 mm.

Referring to FIG. 7, in at least one embodiment, the first hub platform 24 is aligned with the sixth hub platform 46 creating the smallest separation distance between the first outer flange area 30 and the second outer flange area 48. In this embodiment, the tape width dimension 52 is for example 8 mm.

As may be seen in FIGS. 8 to 13, in some embodiments, the first and second locking tabs 54, 56 are disposed inwardly from the plane established by the first interior side 18 and the second interior side 36 respectively. The first locking tab 54 preferably includes a first support structure 90. The second locking tab 56 also includes a second support structure 92. The first and second support structures 90, 92 are sufficiently sturdy to hold the first locking tab 54 and the second locking tab 56 in an engaged position, preventing inadvertent separation of the first hub flange 12 from the second hub flange 32 following assembly of the multi-step reel 10. In a preferred embodiment the first support structure 90 and the second support structure 92 are positioned in a substantially normal direction relative to the plane as established by the first interior side 18 and the second interior side 36, respectively.

In some embodiments, each of the first locking tab 54 and second locking tab 56 include a horizontally extending interlocking member 94, 96, respectively. The first interlocking member 94 at a distal end includes a ramped first hook 98 and the second interlocking member 96 at its distal end includes a ramped second hook 100. Rearwardly and adjacent to each of the ramped first hook 98 and ramped second hook 100 is located a first hook depression 102 and a second hook depression 104, respectively. During engagement of the first locking tab 54 with the second locking tab 56, the first hook 98 is positioned in the second hook depression 104 and the second hook 100 is positioned in the first hook depression 102, where the respective hooks prevent inadvertent separation of the first locking tab 54 from the second locking tab 56.

At least one embodiment the first and second locking tabs 54, 56 are positioned proximate to the left edge of the respective first locking tab opening 66 and second locking tab opening 88, when viewing the first exterior side 20 and the second exterior side 38, respectively.

In some embodiments, the opposite side of each of the first locking tab opening 66 and second locking tab opening 88 respectively, on the interior side, have a first receiving ledge 106 and a second receiving ledge 108, respectively. The first receiving ledge 106 and the second receiving ledge 108 preferably support the bottom of the respective first support structure 90 and a second support structure 92 during the engagement of the first locking tab 54 and the second locking tab 56 together.

Figure 8:
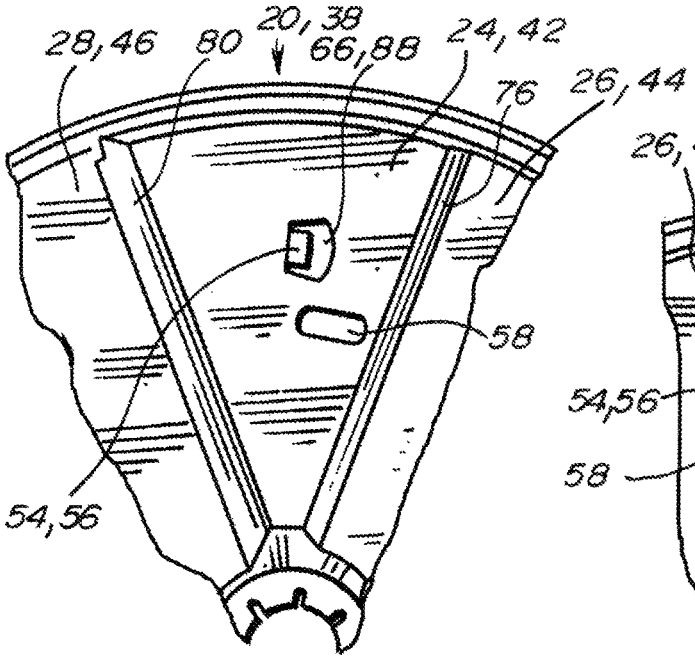
FIG. 8 is an alternative partial detail view of one alternative embodiment of the exterior of a hub platform.

FIG. 8 shows a detail view of the first or second exterior side 20, 38 of the third or sixth hub platform 28, 46. In FIG. 8, the third step wall 80 descends from a first or fourth hub platform 24, 42 to the substantially horizontal surface of the third or sixth hub platform 28, 46. Opposite to the third step wall 80 is located a first step wall 76 which extends from the horizontal surface of the first or fourth hub platforms 24, 42 to the substantially horizontal surface of the second or fifth hub platforms 26, 44. As further seen in FIG. 8 the reel with window 58 is shown. In addition, the first or second locking tab opening 66, 88 is shown. Further, a portion of the first or second locking tab 54, 56 is visible through the first or second locking tab opening 66, 88.

Figure 9:
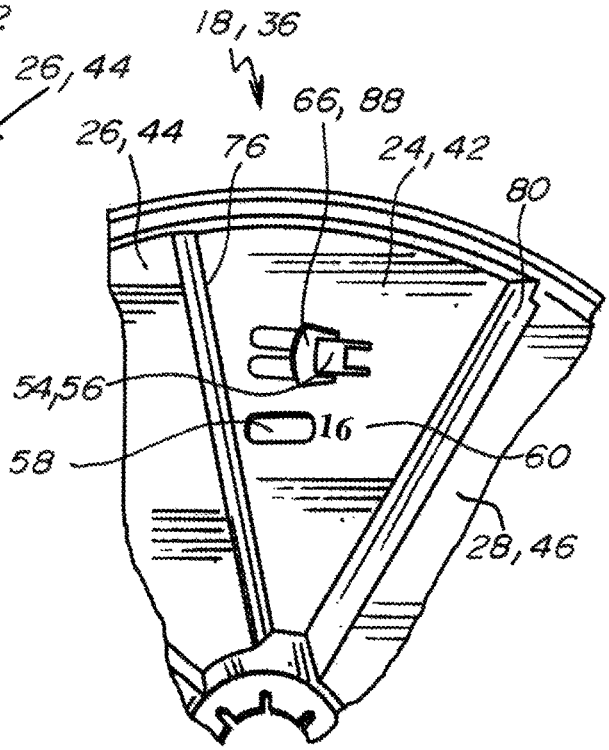
FIG. 9 is an alternative partial detail view of one alternative embodiment of the interior of a hub platform.

FIG. 9 shows a detail view of the first or second interior sides 18, 36 of a first or fourth hub platform 24, 42. In FIG. 9 the first or second locking tab 54, 56 is shown extending partially over the first or second locking tab opening 66, 88. In FIG. 9 the reel width window 58 is also shown to the left of, and adjacent to, the width marking 60.

Figure 10:
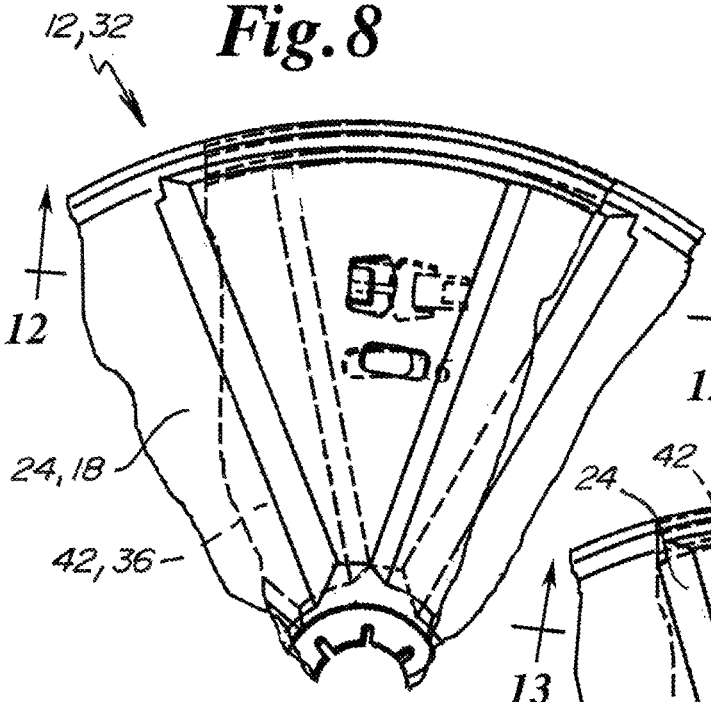
FIG. 10 is an alternative partial detail view of one alternative embodiment of the interior of one hub platform of a first hub flange prior to engagement with the interior of another hub platform of a second hub flange.

FIG. 10 shows a detail view of the pre-engagement position of the first hub flange 12 relative to the second hub flange 32. In FIG. 10 the interior side 18 of the first hub platform 24 is positioned below and is slightly offset relative to the interior side 36 of a fourth hub platform 42. The pre-engagement, pre-rotation position of the first hub platform 24 is shown in solid line. The pre-engagement, pre-rotation position of the fourth hub platform 42 is shown in phantom line.

Figure 12:
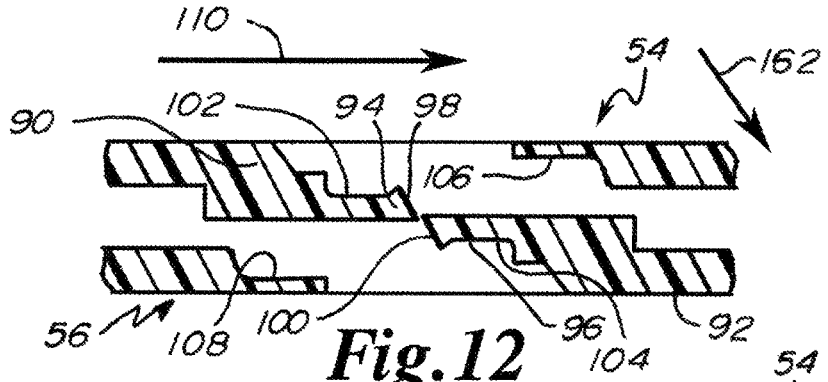
FIG. 12 is a detail partial cross-sectional side view taken along the line 12-12 of FIG. 10, showing one alternative embodiment of one hub platform of a first hub flange during rotational engagement with another hub platform of a second hub flange.
Figure 13:
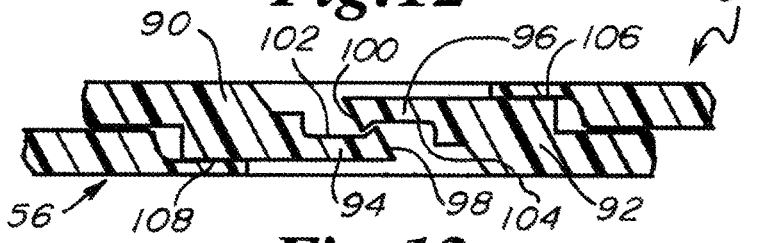
FIG. 13 is a detail partial cross-sectional side view taken along the line 13-13 of FIG. 11, showing one alternative embodiment of one hub platform of a first hub flange following rotational engagement with another hub platform of a second hub flange.
Figure 11:
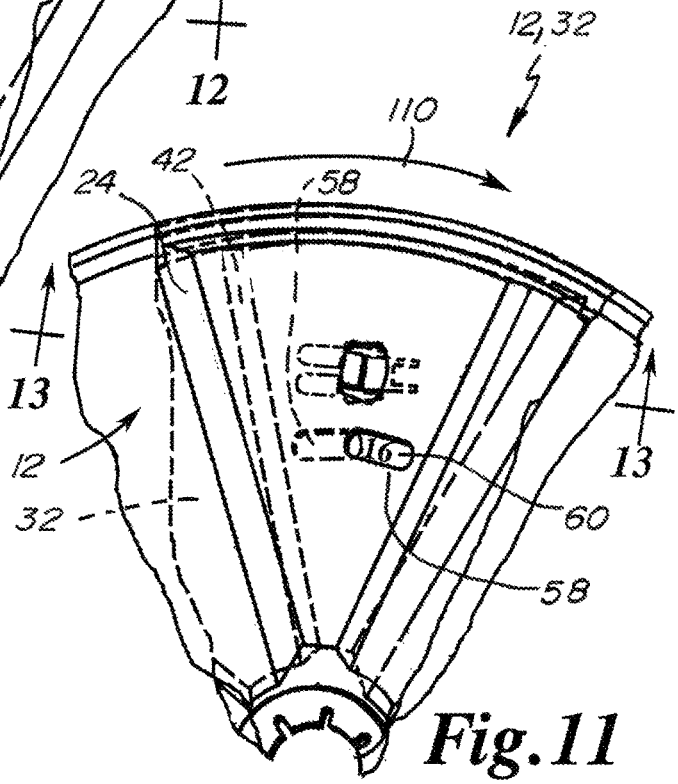
FIG. 11 is an alternative partial detail view of one alternative embodiment of the interior of one hub platform of a first hub flange during rotational engagement with the interior of another hub platform of a second hub flange.

In at least one embodiment, during engagement of the first hub flange 12 to the second hub flange 32, the first hub flange 12 and the second hub flange 32 are rotated in a clockwise direction as indicated by arrow 110 of FIG. 11, as viewing of the first exterior side 20 or the second exterior side 38. Simultaneously with the rotation of the first hub flange 12 relative to the second hub flange 32 in the direction of arrow 110, the first hub flange 12 and the second hub flange 32 are compressed together as shown by arrow 162, so that the first ramped hook 98 is aligned with the second ramped hook 100. (FIG. 12) Additional rotation of the first hub flange 12 relative to the second hub flange 32 engages the first ramped hook 98 to the second ramped hook 100 permitting the ramped hooks to ride up the respective ramps toward the interior of the other hub flange. (FIGS. 12 and 13)

In at least one embodiment, the rotation of the first hub flange 12 relative to the second hub flange 32 in the direction of arrow 110 will continue until such time as the first ramped hook 98 engages the second hook depression 104 and the second ramped hook 100 engages the first hook depression 102 engaging the first hub flange 12 to the second hub flange 32, and locking the first locking tab 54 relative to the second locking tab 56.

In the embodiments as shown in FIGS. 10 and 11 once the first hub flange 12 has been engaged to the second hub flange 32, the width marking 60 of the second hub flange 32 will be aligned with, and will be observable through, the reel width window 58 of the first hub flange 12. The separation distance or tape width dimension 52 for the multi-step reel 10 will be observable when the first hub platform 24 is aligned with the fourth hub platform 42.

In FIG. 11, the pre-rotation position of the first hub platform 24 is shown in phantom line and the post-rotation engagement position with the width marking 60 is observable through the reel width window 58.

FIGS. 12 and 13 show the engagement of the first locking tab 54 to the second locking tab 56 in cross-section. FIG. 12, depicts the pre-engagement alignment of the first hub flange 12 to second hub flange 32. FIG. 13 depicts the engaged position of the first hub flange 12 with the second hub flange 32 and the interlocking of the first locking tab 54 to the second locking tab 56.

Figure 14:
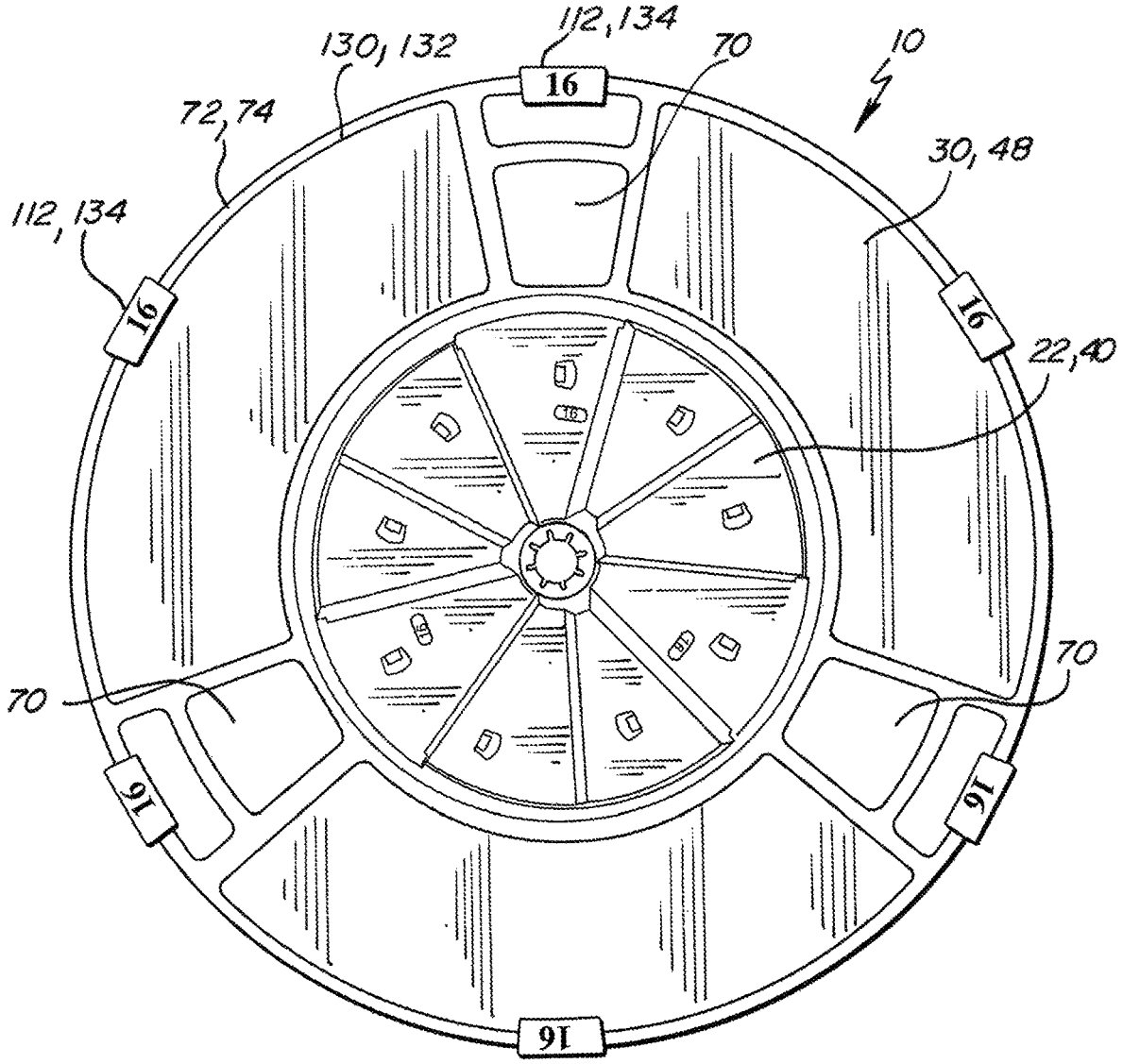
FIG. 14 is an alternative side view of one embodiment of the multi-step reel.

As may be seen in FIG. 14, a multi-step reel 10 is shown having either one piece anti-compression clips 112 or adjustable anti-compression clips 134 engaged to the first and second outer flange edges 72, 74 and the first and second flange rings 130, 132. An exterior surface of the anti-compression clip 112 or adjustable anti-compression clip 134 may include a carrier tape or other flexible ribbon material 68 width marking to facilitate retrieval or transportation of a desired multi-step reel 10 having carrier tape or other material.

Figure 15:
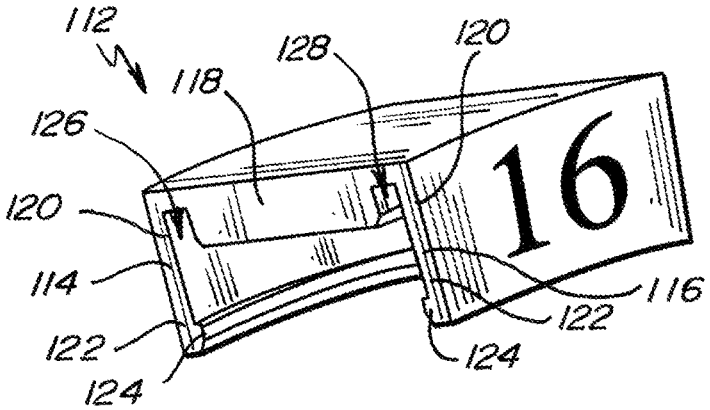
FIG. 15 is a detail isometric view of one alternative embodiment of a clip used with the multi-step reel.

As may be seen in FIG. 15 one embodiment of a one piece anti-compression clip 112 is shown. The anti-compression clip 112 preferably includes a first leg 114 and a second leg 116 as well as a traverse platform 118 extending between, and being integral with, the exterior ends 120 of the first and second legs 114, 116.

In at least one embodiment, the first and second legs 114, 116 include an interior (lower) end 122. Each of the interior ends 122 include a grasping tab 124.

In some embodiments, each of the anti-compression clips 112 have a first flange receiving channel 126 and a second flange receiving channel 128. The first and second flange receiving channels 126, 128 may be located between a respective first and second legs 114, 116 and the traverse platform 118. The first flange receiving channel 126 releasably receives the first outer flange edge 72 and the second flange receiving channel 128 releasably receives the second outer flange edge 74.

In at least one embodiment, the anti-compression clips 112 are positioned to the exterior of an assembled multi-step reel 10 which is transporting carrier tape or other flexible ribbon material 68. The first and second legs 114, 116 are positioned to the exterior of the first and second outer flange edges 72, 74.

Inward pressure is then applied to the top surface of the traverse platform 118 forcing the first leg 114 to the exterior of the first outer flange edge 72 and positioning the first outer flange edge 72 in the first flange receiving channel 126.

The second leg 116 is simultaneously forced to the exterior of the second outer flange edge 74 and the second outer flange edge 74 is positioned in the second flange receiving channel 128. Complete insertion of the anti-compression clips 112 relative to the first outer flange area 30 and second outer flange area 48 will occur when the first outer flange edge 72 is disposed in the first flange receiving channel 126; the second outer flange edge 74 is disposed in the second flange receiving channel 128; the grasping tab 124 of the first leg 114 completely engages the first flange ring 130; and the grasping tab 124 of the second leg 116 completely engages the second flange ring 132. (FIG. 1)

It should be noted that the first and second legs 114, 116 each are resiliently flexible relative to the traverse platform 118 permitting outward flexibility (arrow 170) for positioning to the exterior of the respective first and second outer flange edges 72, 74. Following engagement of the grasping tabs 124 to the respective first and second flange rings 130, 132 the first and second legs 114, 116 may contract relative to each other (arrow 170) to prevent inadvertent separation of the grasping tabs 124 from the first and second flange rings 130, 132. In order to remove and anti-compression clip 112 from the respective first and second outer flange edges 72, 74, the grasping tabs 124 will be required to be manipulated outwardly (arrow 170) from the respective first and second flange rings 130, 132 flexing the first and second legs 114, 116 outwardly. The anti-compression clip 112 may then be withdrawn from contact with the assembled multi-step reel 10.

In some embodiments, the dimension of the traverse platform 118 will vary and have a sufficiently large dimension to position the first leg 114 to the exterior of the first outer flange edge 72 and to position the second leg 116 to the exterior of the second outer flange edge 74.

The traverse platform 118 may include any width dimension as required for use with a multi-step reel 10 accommodating 8 mm, 12 mm, 16 mm, 24 mm, 32 mm, 44 mm, 56 mm, 72 mm, and 88 mm carrier tape or flexible ribbon material 68.

In some embodiments, the exterior surface of one or both of the first leg 114 and second leg 116 will include a marking indicating the size of the internal dimension (arrow 168) of the anti-compression clip 112 between the first outer flange edge 72 and the second outer flange edge 74, identifying the width of the carrier tape or other flexible ribbon material 68 transported by the multi-step reel 10. The width dimensions indicated herein for the carrier tape or other flexible ribbon material 68 are not restrictive and are intended to be broadly construed to accommodate any desired width of carrier tape or other flexible ribbon material 68.

In some embodiments, the dimensions for the height of the respective first and second legs 114 and 116 will be dependent upon the positioning of the respective first and second flange rings 130, 132 relative to the respective first and second outer flange edges 72, 74. In addition, the length dimension selected for the first and second legs 114, 116 may be any desired size, and may be selected dependent on the packaging 164 to be applied to the multi-step reel 10 during the transportation of carrier tape or flexible ribbon material 68.

The anti-compression clips 112 during use maintain a desired separation distance 52 between the first and second outer flange edges 72, 74 during vacuum sealing (packaging 164) of a multi-step reel 10 within an anti-static bag or other container. The anti-compression clips 112 prevent the pinching of the first and second outer flange edges 72, 74 together during vacuum sealing (packaging 164) and the pinching of transported carrier tape or flexible ribbon material 68. In this embodiment, a different sized anti-compression clip 112 will be required for each different size of assembled multi-step reel 10.

Figure 16:
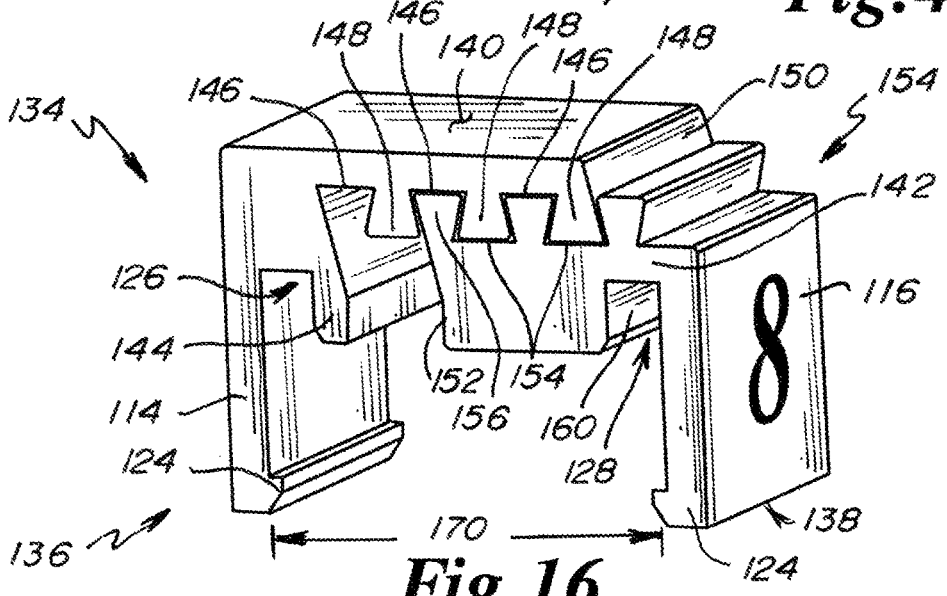
FIG. 16 is a detail alternative isometric view of one embodiment of an adjustable clip used with the multi-step reel.
Figure 17:
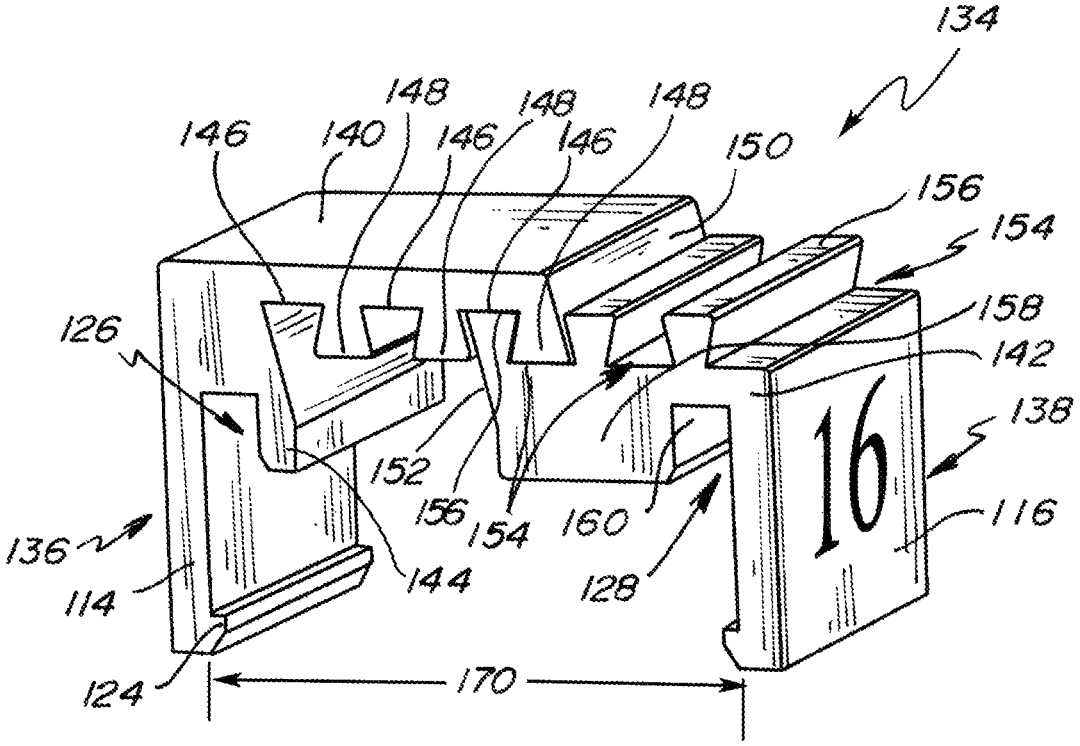
FIG. 17 is a detail alternative isometric view of one embodiment of an adjustable clip used with the multi-step reel.
Figure 19:
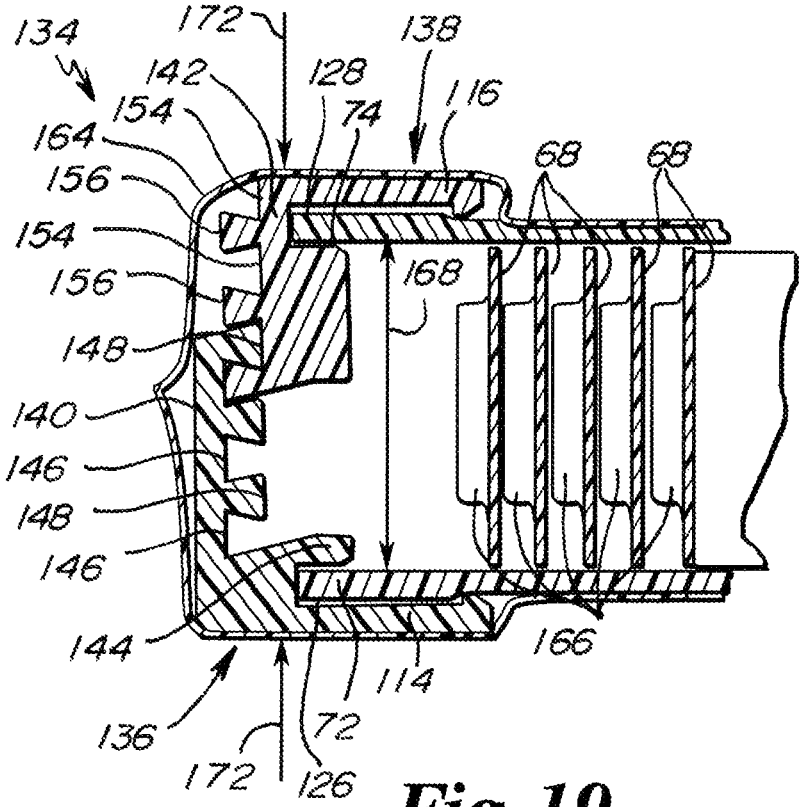
FIG. 19 is a detail cross-sectional side view taken along the line 19-19 of FIG. 18 showing the adjustable clip, material, and packaging.
Figure 18:
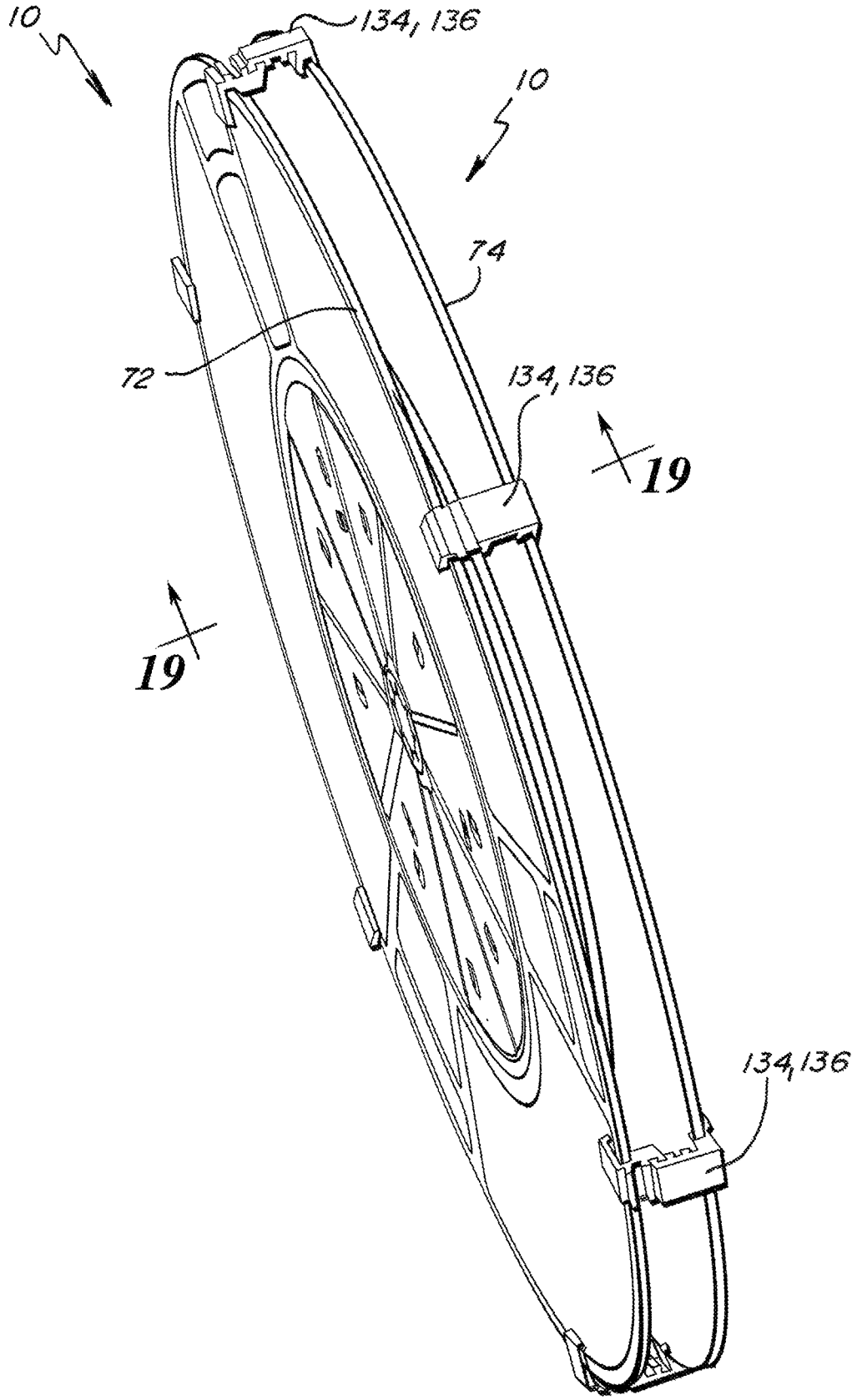
FIG. 18 is an alternative isometric view of one embodiment of the multi-step reel.

In at least one alternative embodiment, an adjustable anti-compression clip 134 is shown in FIGS. 16, 17 and 19. In general the adjustable clip 134 includes a first L-shaped support 136 and a second L-shaped support 138. The first and second L-shaped supports 136, 138 include the first leg 114, second leg 116, first flange receiving channel 126, second flange receiving channel 128, and the grasping tabs 124 as earlier described. The features and attributes for the first and second legs 114, 116, the first and second flange receiving channels 126, 128 and the grasping tabs 124 are identical to the features and attributes as previously described for the anti-compression clip 112. Any alternative features or attributes of the first and second legs 114, 116 the first and second flange receiving channels 126, 128, and the grasping tabs 124 will be described below relative to the adjustable clip 134.

In at least one embodiment, the first and second L-shaped supports 136, 138 replace the traverse platform 118. In general the first L-shaped support 136 includes a first ledge 140 having a substantially horizontal flat top surface. The second L-shaped support 138 includes a second ledge 142 which is disposed below first ledge 140 when the first L-shaped support 136 is releasably engaged to the second L-shaped support 138.

In some embodiments, the first L-shaped support 136 has an extension wall 144 which descends from the first ledge 140. Extension wall 144 is located inwardly from the first leg 114. The extension wall 144 is spaced inwardly from the first leg 114 a sufficient distance to establish the first flange receiving channel 126. Extension wall 144 includes an inner surface which has the shape of an outside surface of an isosceles trapezoid, with the shorter parallel side positioned downwardly.

In a preferred embodiment, the lower surface of the first ledge 140 includes a plurality of alternating elongated isosceles trapezoid shaped first troughs 146 and first beams 148. The first troughs 146 are configured so that the shorter parallel side is downwardly relative to the first ledge 140. The first beams 148 are orientated so that the longer parallel side is downwardly relative to the first ledge 140.

In other embodiments, the orientation of the elongated isosceles trapezoid shaped first troughs 146 and first beams 148 may be reversed by 180°, where the shorter parallel side of the first troughs 146 are positioned upwardly towards the first ledge 140 and the longer parallel side of the first beams 148 are positioned upwardly towards the first ledge 140.

In some embodiments, the exterior most first beam 148 relative to the first leg 114 includes a first angle exterior wall 150. The first exterior wall 150 forms the outside surface of one of the non-parallel sides of the elongated isosceles trapezoid shaped beams 148.

In one embodiment the second L-shaped support 138 includes a second ledge 142. The second ledge 142 is at a lower elevation relative to the first ledge 140. In some embodiments, the second ledge 142 includes a number of alternating and upwardly extending elongated isosceles trapezoid shaped second troughs 154 and second beams 156.

The second troughs 154 are configured so that the longer parallel side is positioned downwardly relative to the second ledge 142. The second beams 156 are oriented so that the longer parallel side is positioned upwardly relative to the second ledge 142.

In other embodiments, the orientation of the elongated isosceles trapezoid shaped second troughs 154 and second beams 156 may be reversed by 180° where the longer parallel side of the second troughs 154 is upwardly and the longer parallel side of the second beams 156 is downwardly relative to the second ledge 142.

In at least one embodiment, an engagement wall 152 is located opposite to the second leg 116. The engagement wall 152 has a matching angular shape for positioning adjacent to, and in contact with, the interior surface of the exterior wall 144. An upper portion of the engagement wall 152 also forms an exterior surface of the distal elongated isosceles trapezoid shaped second beam 156 relative to the second leg 116.

In some embodiments, a structural block 158 descends from the second ledge 142. During use, the extension wall 144 and the structural block 158 are positioned adjacent to each other and are disposed between the first and second outer flange edges 72, 74 to provide support to the first and second outer flange edges 72, 74 preventing pinching therebetween when the assembled multi-step reel 10 is vacuum sealed within an anti-static bag 164 during transportation of carrier tape or other flexible ribbon material 68.

The structural block 158 preferably includes an inner surface 160. In some embodiments, the inner surface 160 is separated inwardly from the interior surface of the second leg 116 a sufficient distance to establish the second flange receiving channel 128.

In at least one embodiment, as shown in FIG. 16, the first and second L-shaped supports 136, 138 are engaged to each other for attachment to the first and second outer flange edges 72, 74. In the first example, the first and second L-shaped supports 136, 138 are used to support a multi-step reel 10 constructed for transportation of an 12 mm wide carrier tape or other flexible ribbon material 68. In this example, the distal second beam 156 is positioned centrally and is proximate to, but separated from, the engagement wall 152 and is aligned either forwardly or rearwardly of the first trough 146 which is positioned centrally relative to the extension wall 144. In this example the intermediate second beam 156 will be aligned with the distal first trough 146 which is proximate to the first exterior wall 150. In addition, the distal first beam 148 will be aligned with the intermediate second trough 154. The intermediate first beam 148 will be aligned with the distal second trough 154 which is proximate to the engagement wall 152.

The second and first beams 156, 148 may then be slid into the interior of the respective first and second troughs 146, 154 respectively, to engage the first L-shaped support 136 to the second L-shaped support 138, preventing inadvertent separation therebetween.

In at least one embodiment following the alignment of the second beams 156 with the first troughs 146 and the alignment of the first beams 148 with the second troughs 154 as described for an 12 mm carrier tape or other flexible ribbon material 68, the second and first beams 156, 148 may be slid into the interior of the respective first and second troughs 146, 154 respectively, to engage the first L-shaped support 136 to the second L-shaped support 138.

It should be noted that the engagement of the first and second beams 148, 156 into the second and first troughs 154, 146 will be similar to a key-groove mechanical attachment.

In this embodiment the isosceles trapezoid shape of the first beams 148 (wide edge down) is inserted within the isosceles trapezoidal shaped second troughs 154 (wide edge down) where the narrow side of an adjacent second beam 156 and first trough 146 prevents the separation of the first L-shaped support 136 from the second L-shaped support 138 in a direction perpendicular or normal to the flat horizontal top surface of the first ledge 140. The mating engagement of the first beams 148 within the second troughs 154 to adjacent second beams 156 within the first troughs 146, locks the first L-shaped support 136 relative to the second L-shaped support 138. (FIGS. 16 and 17)

In an alternative example, for transportation of a 16 mm wide carrier tape or other flexible ribbon material 68 (FIG. 17) the distal second beam 156 as adjacent to the engagement wall 152 is aligned either forwardly or rearwardly from the distal first trough 146 proximate to the first exterior wall 150. The second and first beams 156, 148 may then be slid into the interior of the respective first and second troughs 146, 154 respectively, to engage the first L-shaped support 136 the second L-shaped support 138 preventing inadvertent separation therebetween as earlier described.

In at least one embodiment the first and/or second hub flanges 12, 32 may include a rim which may be used to support the first and second outer flange areas 30, 48. Further, in at least one embodiment the first and second hub flanges 12, 32 may have any desired diameter dimension which may be selected dependent upon factors such as carrier tape bending radius, carrier tape pocket size and pocket spacing. Examples of first and second hub flanges 12, 32 diameter dimensions include but are not necessarily restricted 3", 4", 6" and 7". In addition, examples of the diameter dimensions for the multi-step reel 10 may be unlimited, but generally are 7", 13" and 15". The dimensions provided for the diameter of the multi-step reel 10 have been provided for illustrative purposes only, and the diameter dimensions for the multi-step reel 10 are not restricted to the dimensions identified herein.

In at least one embodiment the first and/or second hub flanges 12, 32 and the multi-step reel 10 may be formed out of any desired materials, including but not limited to the use of plastics, fiberglass, wood, metal, carbon based materials, natural materials, synthetic materials and combinations thereof.

In at least one embodiment the first and second outer flange areas 30, 48 have a flange window 70 which may be used to determine the volume of carrier tape remaining on a multi-step reel 10.

In some embodiments, the anti-compression clips 112 may be made in a single width to match the width dimension selected for the multi-step reel 10. Examples of common multi-step reel 10 widths include but are not necessarily limited to 8 mm, 12 mm, 16 mm, 24 mm, 32 mm, 44 mm, 56 mm, 72 mm, and 88 mm.

In some embodiments, the adjustable clips 134 may be formed for use with multi-step reels 10 transporting material having a width dimension of 8 mm, 12 mm or 16 mm. Alternatively, the adjustable clips 134 may be formed for use with multi-step reels 10 transporting material having a width dimension of 24 mm, 32 mm or 44 mm. Further the adjustable clips 134 may be formed for use with multi-step reels 10 transporting material having a width dimension of 56 mm, 72 mm or 88 mm.

In some embodiments, the number of anti-compression clips 112 and/or adjustable clips 134 to be engaged to first and second outer flange edges 72, 74 will be determined based on variables such as the vacuum level/pressure to be placed onto the multi-step reel 10 during packaging, the gap from last wrap of carrier tape to the first and second outer flange edges 72, 74, and the width of carrier tape to be transported.

In at least one embodiment the first and/or second hub flanges 12, 32 nest within each other for reduced shipping and storage needs.

In a first alternative embodiment, a multi-step reel comprises a disc shaped first hub flange having a first arbor hole, a first interior side, a first exterior side, a first platform area and a first outer flange area; the first platform area being adjacent to, and extends outwardly from, the first arbor hole, the first platform area having a first hub platform and a second hub platform, the first hub platform having a first depth dimension, and the second hub platform having a second depth dimension, the first outer flange area being adjacent and connected to, and extending outwardly from the first platform area; and a disc shaped second hub flange having a second arbor hole, a second interior side, a second exterior side, a second platform area and a second outer flange area; the second platform being connected to, and extending outwardly from, the second arbor hole, the second platform area having a third hub platform and a fourth hub platform, the third hub platform having a third depth dimension and the fourth hub platform having a fourth depth dimension, the second outer flange area being adjacent to, and extending outwardly from, the second platform area; wherein the first interior side of the first hub platform is disposed adjacent to the second interior side of one of the third hub platform and the fourth hub platform defining a width dimension.

In a second alternative embodiment according to the first alternative embodiment, the first platform area further comprises a fifth hub platform having a fifth depth dimension and the second platform area further comprises a sixth hub platform having a sixth depth dimension.

In a third alternative embodiment according to the second alternative embodiment, the first arbor hole comprises at least one spline opening.

In a fourth alternative embodiment according to the second alternative embodiment, at least two of the first depth dimension, the second depth dimension, and the fifth depth dimension are different from each other.

In a fifth alternative embodiment according to the second alternative embodiment, at least two of the third depth dimension, the fourth depth dimension, and the sixth depth dimension are different from each other.

In a sixth alternative embodiment according to the second alternative embodiment, at least one of the first hub platform, the second hub platform, the third hub platform, the fourth hub platform, the fifth hub platform and the sixth hub platform has a substantially triangular shape.

In a seventh alternative embodiment according to the sixth alternative embodiment, the first hub platform, the second hub platform, the third hub platform, the fourth hub platform, the fifth hub platform and the sixth hub platform are substantially triangular shaped.

In an eighth alternative embodiment according to the second alternative embodiment, the first interior side of at least one of the first hub platform, the second hub platform, and the fifth hub platform have at least one first locking tab extending inwardly from the first interior side.

In an ninth alternative embodiment according to the eighth alternative embodiment, the second interior side of at least one of the third hub platform, the fourth hub platform, and the sixth hub platform have at least one second locking tab extending inwardly from the second interior side.

In an tenth alternative embodiment according to the second alternative embodiment, at least one of the first hub platform, the second hub platform, and the fifth hub platform have at least one window.

In an eleventh alternative embodiment according to the second alternative embodiment, at least one of the third hub platform, the fourth hub platform, and the sixth hub platform have at least one window.

In a twelfth alternative embodiment according to the tenth alternative embodiment, the second interior side of at least one of the third hub platform, the fourth hub platform, and the sixth hub platform have at least one width marking, the at least one width marking being aligned with the at least one window of the first hub platform, the second hub platform, and the fifth hub platform.

In a thirteenth alternative embodiment according to the eleventh alternative embodiment, the first interior side of at least one of the first hub platform, the second hub platform, and the fifth hub platform has at least one width marking, the at least one width marking being aligned with the at least one window of the third hub platform, the fourth hub platform, and the sixth hub platform.

In a fourteenth alternative embodiment according to the first alternative embodiment, a first support ledge is disposed between the first platform area and the first outer flange area.

In a fifteenth alternative embodiment according to the first alternative embodiment, a second support ledge is disposed between the third platform area and the second outer flange area.

In a sixteenth alternative embodiment according to the ninth alternative embodiment, the first depth dimension is equal to the third depth dimension.

In a seventeenth alternative embodiment according to the sixteenth alternative embodiment, the second depth dimension is equal to the fourth depth dimension.

In an eighteenth alternative embodiment according to the seventeenth alternative embodiment, the fifth depth dimension is equal to the sixth depth dimension.

In a nineteenth alternative embodiment according to the ninth alternative embodiment, the multi-step reel has a first dissembled state and a second assembled state, and wherein in the second assembled state the first interior surface of the first hub platform is adjacent to the second interior surface of the third hub platform and the at least one first locking tab is engaged to the at least one second locking tab.

In a twentieth alternative embodiment according to the ninth alternative embodiment, the multi-step reel has a first dissembled state and a second assembled state, and wherein in the second assembled state the first interior surface of the first hub platform is adjacent to the second interior surface of the fourth hub platform and the at least one first locking tab is engaged to the at least one second locking tab.

In a twenty-first alternative embodiment according to the ninth alternative embodiment, the multi-step reel has a first dissembled state and a second assembled state, and wherein in the second assembled state the first interior surface of the first hub platform is adjacent to the second interior surface of the sixth hub platform and the at least one first locking tab is engaged to the at least one second locking tab.

In a twenty-second alternative embodiment according to the first alternative embodiment, the first interior side of at least one of the first hub platform and the second hub platform has at least one first locking tab extending inwardly from the first interior side, and the second interior side of at least one of the third hub platform and the fourth hub platform has at least one second locking tab extending inwardly from the second interior side.

In a twenty-third alternative embodiment according to the twenty-second alternative embodiment, the multi-step reel has a first dissembled state and a second assembled state, and wherein in the second assembled state the first interior surface of the first hub platform is adjacent to the second interior surface of the third hub platform and the at least one first locking tab is engaged to the at least one second locking tab.

In a twenty-fourth alternative embodiment according to the twenty-second alternative embodiment, the multi-step reel has a first dissembled state and a second assembled state, and wherein in the second assembled state the first interior surface of the first hub platform is adjacent to the second interior surface of the fourth hub platform and the at least one first locking tab is engaged to the at least one second locking tab.

In a twenty-fifth alternative embodiment a multi-step reel comprises: a disc shaped first hub flange comprising a first arbor hole, a first interior side and a first exterior side; a first platform area adjacent to and extending outwardly from the first hub flange, the first platform area having a first hub platform, a second hub platform, and a third hub platform, the first hub platform having a first depth dimension, the second hub platform having a second depth dimension, and the third hub platform having a third depth dimension, the first interior side of each of the first hub platform, the second hub platform, and the third hub platform having at least one first locking tab extending inwardly from the first interior side, the first hub platform, the second hub platform, and the third hub platform having at least one window, the first interior side of the first hub platform, the second hub platform, and the third hub platform having at least one width marking; a first outer flange area adjacent to and extending outwardly from the first platform area; and a disc shaped second hub flange comprising a second arbor hole, a second interior side and a second exterior side; a second platform area adjacent to and extending outwardly from the second hub flange, the second platform area having a fourth hub platform, a fifth hub platform, and a sixth hub platform, the fourth hub platform having a fourth depth dimension, the fifth hub platform having a fifth depth dimension, and the sixth hub platform having a sixth depth dimension, the second interior side of each of the fourth hub platform, the fifth hub platform, and the sixth hub platform having at least one second locking tab extending inwardly from the second interior side, the fourth hub platform, the fifth hub platform, and the sixth hub platform having the at least one window, the second interior side of the fourth hub platform, the fifth hub platform, and the sixth hub platform having the at least one width marking; and a second outer flange area adjacent to and extending outwardly from the second platform area; wherein the first interior side of the first hub platform is disposed adjacent to the second interior side of one of the fourth hub platform, the fifth hub platform, and the sixth hub platform, defining a tape width dimension.

Applicant incorporates by reference herein the disclosures of U.S. Pat. No. D363,659 for Clip for a Band; U.S. Pat. No. 5,584,102 for a Locking Clip for a Reel Band; U.S. Pat. No. 5,460,268 for a Band Apparatus for a Reel Assembly; and U.S. Pat. No. 4,726,534 for a Convertible Reel Assembly in their entireties.

This completes the description of the preferred and alternate embodiments of the invention. Those skilled in the art may recognize other equivalents to the specific embodiment described herein which equivalents are intended to be encompassed by the claims attached hereto.

The above disclosure is intended to be illustrative and not exhaustive. This description will suggest many variations and alternatives to one of ordinary skill in this art. The various elements shown in the individual figures and described above may be combined or modified as desired. All these alternatives and variations are intended to be included within the scope of the claims where the term "comprising" means "including, but not limited to".

These and other embodiments which characterize the invention are pointed out with particularity in the claims annexed hereto and forming a part hereof. However, for further understanding of the invention, its advantages and objectives obtained by its use, reference should be made to the drawings which form a further part hereof and the accompanying descriptive matter, in which there is illustrated and described embodiments of the invention.

The invention claimed is:

1. A multi-step reel comprising:

a first hub flange having a first interior side and a first exterior side, a first arbor hole, a first platform area, and a first outer flange area defining a plane, said first platform area being adjacent to and outwardly from said first arbor hole, said first platform area having a first hub platform, a second hub platform, and a third hub platform, said first hub platform having a first depth dimension relative to said plane, said second hub platform having a second depth dimension relative to said plane, and said third hub platform having a third depth dimension relative to said plane, said first outer flange area being adjacent to and extending outwardly from said first platform area; and a second hub flange having a second interior side and a second exterior side, a second arbor hole, a second platform area, and a second outer flange area having a second plane, said second platform area being adjacent to and outwardly from said second arbor hole, said second platform area having a fourth hub platform, a fifth hub platform, and a sixth hub platform, said fourth hub platform having a fourth depth dimension relative to said second plane, said fifth hub platform having a fifth depth dimension relative to said second plane, and said sixth hub platform having a sixth depth dimension relative to said second plane, said second outer flange area being adjacent to and extending outwardly from said second platform area, wherein said first hub platform is disposed adjacent to one of said fourth hub platform, said fifth hub platform, and said sixth hub platform defining a width dimension, and further wherein at least two of said first depth dimension, said second depth dimension and said third depth dimension are different from each other, and at least two of said fourth depth dimension, said fifth depth dimension, and said sixth depth dimension are different from each other.

2. The multi-step reel according to claim 1, wherein at least one of said first hub platform, said second hub platform, said third hub platform, said fourth hub platform, said fifth hub platform and said sixth hub platform has a substantially triangular shape.

3. The multi-step reel according to claim 2, wherein said first hub platform, said second hub platform, said third hub platform, said fourth hub platform, said fifth hub platform and said sixth hub platform are substantially triangular shaped.

4. The multi-step reel according to claim 1, wherein said first interior side of at least one of said first hub platform, said second hub platform, and said third hub platform have at least one first locking tab extending inwardly from said first interior side.

5. The multi-step reel according to claim 4, wherein said second interior side of at least one of said fourth hub platform, said fifth hub platform, and said sixth hub platform have at least one second locking tab extending inwardly from said second interior side.

6. The multi-step reel according to claim 5, wherein said first depth dimension is equal to said fourth depth dimension.

7. The multi-step reel according to claim 6, wherein said second depth dimension is equal to said fifth depth dimension.

8. The multi-step reel according to claim 7, wherein said third depth dimension is equal to said sixth depth dimension.

9. The multi-step reel according to claim 5, wherein said multi-step reel has a first dissembled state and a second assembled state, and wherein in said second assembled state said first interior side of said first hub platform is adjacent to said second interior side of said fourth hub platform and said at least one first locking tab is engaged to said at least one second locking tab.

10. The multi-step reel according to claim 5, wherein said multi-step reel has a first dissembled state and a second assembled state, and wherein in said second assembled state said first interior side of said first hub platform is adjacent to said second interior side of said fifth hub platform and said at least one first locking tab is engaged to said at least one second locking tab.

11. The multi-step reel according to claim 5, wherein said multi-step reel has a first dissembled state and a second assembled state, and wherein in said second assembled state said first interior side of said first hub platform is adjacent to said second interior side of said sixth hub platform and said at least one first locking tab is engaged to said at least one second locking tab.

12. The multi-step reel according to claim 1, at least one of said first hub platform, said second hub platform, and said third hub platform having at least one first window.

13. The multi-step reel according to claim 12, said second interior side of at least one of said fourth hub platform, said fifth hub platform, and said sixth hub platform having at least one second width marking, said at least one second width marking being aligned with said at least one first window in an assembled configuration where said first hub flange is engaged to said second hub flange.

14. The multi-step reel according to claim 1, at least one of said fourth hub platform, said fifth hub platform, and said sixth hub platform having at least one second window.

15. The multi-step reel according to claim 14, said first interior side of at least one of said first hub platform, said second hub platform, and said third hub platform having at least one first width marking, said at least one first width marking being aligned with said at least one second window in an assembled configuration where said first hub flange is engaged to said second hub flange.

16. The multi-step reel according to claim 1, wherein a first tape support ledge is disposed between said first platform area and said first outer flange area.

17. The multi-step reel according to claim 1, wherein a second tape support ledge is disposed between said second platform area and said second outer flange area.

18. The multi-step reel according to claim 1, said first interior side of at least one of said first hub platform, said second hub platform, and said third hub platform has at least one first locking tab extending inwardly from said first interior side, and said second interior side of at least one of said fourth hub platform, said fifth hub platform, and said sixth hub platform has at least one second locking tab extending inwardly from said second interior side.

19. The multi-step reel according to claim 18, wherein said multi-step reel has a first dissembled state and a second assembled state, and wherein in said second assembled state said first interior side of said second hub platform is adjacent to said second interior side of said fourth hub platform and said at least one first locking tab is engaged to said at least one second locking tab.

20. The multi-step reel according to claim 18, wherein said multi-step reel has a first dissembled state and a second assembled state, and wherein in said second assembled state said first interior side of said second hub platform is adjacent to said second interior side of said fifth hub platform and said at least one first locking tab is engaged to said at least one second locking tab.

21. The multi-step reel according to claim 18, wherein said multi-step reel has a first dissembled state and a second assembled state, and wherein in said second assembled state said first interior side of said second hub platform is adjacent to said second interior side of said sixth hub platform and said at least one first locking tab is engaged to said at least one second locking tab.

22. The multi-step reel according to claim 18, wherein said multi-step reel has a first dissembled state and a second assembled state, and wherein in said second assembled state said first interior side of said third hub platform is adjacent to said second interior side of said fourth hub platform and said at least one first locking tab is engaged to said at least one second locking tab.

23. The multi-step reel according to claim 18, wherein said multi-step reel has a first dissembled state and a second assembled state, and wherein in said second assembled state said first interior side of said third hub platform is adjacent to said second interior side of said fifth hub platform and said at least one first locking tab is engaged to said at least one second locking tab.

24. The multi-step reel according to claim 18, wherein said multi-step reel has a first dissembled state and a second assembled state, and wherein in said second assembled state said first interior side of said third hub platform is adjacent to said second interior side of said sixth hub platform and said at least one first locking tab is engaged to said at least one second locking tab.

25. A multi-step reel comprising:

a first hub flange comprising a first interior side, a first exterior side, a first arbor hole, a first platform area and a first outer flange area defining a plane, said first platform area being adjacent to and extending outwardly from said first arbor hole, said first platform area having a first hub platform, a second hub platform, and a third hub platform, said first hub platform having a first depth dimension relative to said plane, said second hub platform having a second depth dimension relative to said plane, and said third hub platform having a third depth dimension relative to said plane, said first interior side of each of said first hub platform, said second hub platform, and said third hub platform having at least one first locking tab extending inwardly from said first interior side, said first hub platform, said second hub platform, and said third hub platform having at least one first window, said first interior side of said first hub platform, said second hub platform, and said third hub platform having at least one first width marking, said first outer flange area being adjacent to and extending outwardly from said first platform area; and a second hub flange comprising a second interior side, a second exterior side, a second arbor hole, a second platform area, and a second outer flange area having a second plane, said second platform area being adjacent to and extending outwardly from said second arbor hole, said second platform area having a fourth hub platform, a fifth hub platform, and a sixth hub platform, said fourth hub platform having a fourth depth dimension relative to said second plane, said fifth hub platform having a fifth depth dimension relative to said second plane, and said sixth hub platform having a sixth depth dimension relative to said second plane, said second interior side of each of said fourth hub platform, said fifth hub platform, and said sixth hub platform having at least one second locking tab extending inwardly from said second interior side, said fourth hub platform, said fifth hub platform, and said sixth hub platform having at least one second window, said second interior side of said fourth hub platform, said fifth hub platform, and said sixth hub platform having at least one second width marking, said second outer flange area being adjacent to and extending outwardly from said second platform area, wherein said first interior side of said first hub platform is disposed adjacent to, and engaged with said second interior side of one of said fourth hub platform, said fifth hub platform, and said sixth hub platform, defining a width dimension, and further wherein said first depth dimension is equal to said fourth depth dimension, said second depth dimension is equal to said fifth depth dimension, and said third depth dimension is equal to said sixth depth dimension, and said first depth dimension is not equal to said second depth dimension or said third depth dimension, and said second depth dimension is not equal to said third depth dimension.

* * * * *